US010578343B2

(12) United States Patent
Lesage et al.

(10) Patent No.: US 10,578,343 B2
(45) Date of Patent: Mar. 3, 2020

(54) MECHANICAL SUBCOOLING OF TRANSCRITICAL R744 REFRIGERATION SYSTEMS USING SEPARATE R-744 OR OTHER REFRIGERANTS UNITS FOR MECHANICAL SUBCOOLING AND AS A HEAT PUMP FOR HEAT RECLAIM PURPOSES

(71) Applicant: SYSTÈMES LMP INC., Laval (CA)

(72) Inventors: Gaétan Lesage, Blainville (CA); Jordan Kantchev, Longueuil (CA)

(73) Assignee: SYSTÈMES LMP INC., Laval, Québec (CA)

( * ) Notice: Subject to any disclaimer, the term of this patent is extended or adjusted under 35 U.S.C. 154(b) by 99 days.

(21) Appl. No.: 15/635,895

(22) Filed: Jun. 28, 2017

(65) Prior Publication Data

US 2019/0003744 A1 Jan. 3, 2019

(51) Int. Cl.

| | |
|---|---|
| ***F25B 9/10*** | (2006.01) |
| ***F25B 9/00*** | (2006.01) |
| ***F25B 40/02*** | (2006.01) |
| ***F25B 41/04*** | (2006.01) |
| ***F25B 7/00*** | (2006.01) |
| ***F25B 5/02*** | (2006.01) |
| ***F25B 49/02*** | (2006.01) |
| *F25B 6/04* | (2006.01) |

(52) U.S. Cl.

CPC ..... *F25B 9/10* (2013.01); *F25B 5/02* (2013.01); *F25B 7/00* (2013.01); *F25B 9/008* (2013.01); *F25B 40/02* (2013.01); *F25B 41/04* (2013.01); *F25B 49/02* (2013.01); *F25B 6/04* (2013.01); *F25B 2309/061* (2013.01); *F25B 2339/047* (2013.01); *F25B 2400/0417* (2013.01); *F25B 2400/075* (2013.01); *F25B 2400/13* (2013.01); *F25B 2400/23* (2013.01); *F25B 2600/2501* (2013.01); *F25B 2600/2513* (2013.01)

(58) Field of Classification Search

CPC ..... F25B 9/10; F25B 5/02; F25B 7/00; F25B 9/008; F25B 40/02; F25B 41/04; F25B 49/02; F25B 6/04; F25B 2309/061; F25B 2339/047; F25B 2400/0417; F25B 2400/075; F25B 2400/13; F25B 2400/16; F25B 2400/23; F25B 2600/2501; F25B 2600/2513

USPC ..... 62/79

See application file for complete search history.

(56) References Cited

U.S. PATENT DOCUMENTS

| | | | | |
|---|---|---|---|---|
| 9,109,816 | B2 | 8/2015 | Kantchev | |
| 2017/0051950 | A1* | 2/2017 | Uselton | F25B 7/00 |

* cited by examiner

*Primary Examiner* — Joseph F Trpisovsky
(74) *Attorney, Agent, or Firm* — PRAXIS

(57) ABSTRACT

A mechanical subcooling system operatively connectable to a transcritical R-744 refrigeration system resulting in an energy efficiency ratio of a level comparable to that of refrigeration systems using common refrigerants. Mechanical subcooling increases the refrigeration capacity without increasing the power consumption of the refrigeration system's compressors. The compressors used to provide the refrigeration capacity for the subcooling process operate at much more favorable conditions, thus having a very high energy efficiency ratio. The result is higher refrigeration capacity and lower power consumption.

9 Claims, 4 Drawing Sheets

MECHANICAL SUBCOOLING OF TRANSCRITICAL R744 REFRIGERATION SYSTEMS USING SEPARATE R-744 OR OTHER REFRIGERANTS UNITS FOR MECHANICAL SUBCOOLING AND AS A HEAT PUMP FOR HEAT RECLAIM PURPOSES

TECHNICAL FIELD

The present disclosure concerns refrigeration systems, and more particularly R-744 transcritical refrigeration systems with mechanical subcooling, heat pump heat reclaim and floating head pressure.

BACKGROUND OF THE INVENTION

R-744 transcritical refrigeration systems are used in supermarkets to refrigerate or to maintain perishable products in a frozen state, such as foodstuff.

A major disadvantage of a transcritical R-744 refrigeration system is its low energy efficiency ratio (EER) during the warmer periods of the year (critical point 87.761° F.).

When the outside air temperature is such that the R-744 vapors cooled by an exterior heat exchanger (gas cooler) have a temperature higher than the critical point, there will be no condensation. Therefore, in order to obtain a liquid state, the cooled R-744 vapors are fed though a throttling device, thus reducing the pressure and the temperature of the vapors. The result is a mixture of liquid and vapor which, at an ambient temperature of 90° F., will have a ratio of 55% liquid and 45% vapor. It is evident that the mass flow of the compressor in transcritical operation has to be almost doubled in order to obtain the required refrigeration capacity. Hence, there is a necessity for a system and method for increasing the efficiency of an R-744 transcritical refrigeration system.

SUMMARY OF THE INVENTION

It is an object of the present disclosure to provide an improved transcritical R-744 refrigeration system with a higher energy efficiency ratio.

It is a further object of the present disclosure to provide a transcritical refrigeration system with an energy efficiency ratio (EER) of a level comparable to that of refrigeration systems using common refrigerants operating in subcritical mode, by means of a separate subcooling system using R-744 or other refrigerants, connected to the transcritical R-744 system by means of heat exchangers.

Accordingly, the present disclosure provides a mechanical subcooling system for use with a transcritical R-744 refrigeration system having at least one first compressor for compressing R-744 vapors directed to a cooler operatively connected to a throttling device, for reducing the pressure and temperature of the R-744 vapors to a level required for the normal operation of the R-744 refrigeration system, through a first heat exchanger, the first heat exchanger being operatively connected to the at least one compressor to provide the R-744 vapors to the at least one first compressor and to receive compressed R-744 vapors from the at least one first compressor, a by-pass valve for maintaining a required flow of R-744 vapors through the first heat exchanger, a first receiver for receiving the R-744 vapors from the first throttling device, and a condenser, the mechanical subcooling system comprising a second heat exchanger operatively connected between the at least one first compressor and the cooler, a third heat exchanger operatively connected between the first heat exchanger and the first receiver for subcooling the R-744 exiting the gas cooler, a first pressure regulating valve (flash gas bypass valve) for feeding R-744 vapors from the first receiver to the at least one first compressor, and at least one second compressor for mechanically subcooling of R-744 vapors leaving the cooler through the third heat exchanger or for heat reclaim through the second heat exchanger, wherein the mechanical subcooling system is operatively connectable to the R-744 refrigeration system.

In an embodiment, the mechanical subcooling system further comprises a second pressure regulating valve operatively connected between the at least one second compressor and the condenser.

In an embodiment, the transcritical R-744 refrigeration system further including a fourth heat exchanger operatively connected between the at least one second compressor and the condenser for transferring heat to a circulation system to be used during warm periods for dehumidification purposes.

In an embodiment, the mechanical subcooling system further comprises a second pressure regulating device operatively connected between the fourth heat exchanger and the condenser.

In an embodiment, the mechanical subcooling system further comprises a first motorized valve operatively connected between the third heat exchanger and the at least one second compressor and a second motorized valve operatively connected between the second heat exchanger and the at least one second compressor.

In an embodiment, when subcooling is required, the first motorized valve is open and the second motorized valve is closed.

In an embodiment, the mechanical subcooling system further comprises a first expansion valve operatively connected between a second receiver and the third heat exchanger, and a second expansion valve operatively connected between the second receiver and the second heat exchanger.

In an embodiment, when subcooling is not required, the first expansion valve and the first motorized valve are closed, and the second expansion valve and the second motorized valve are opened.

In an embodiment, the mechanical subcooling system further comprises a third throttling device, wherein the subcooling system uses R-744 as its refrigerant, the condenser is replaced by a gas cooler, and the subcooling system is operable as a transcritical R-744 system.

The present disclosure also provides a transcritical R-744 refrigeration system having at least one first compressor for compressing R-744 vapors directed to a cooler operatively connected to a throttling device, for reducing the pressure and temperature of the R-744 vapors to a level required for the normal operation of the R-744 refrigeration system, through a first heat exchanger, the first heat exchanger being operatively connected to the at least one first compressor to provide the R-744 vapors to the at least one first compressor and to receive compressed R-744 vapors from the at least one first compressor, a by-pass valve for maintaining a required flow of R-744 vapors through the first heat exchanger, a receiver for receiving a R-744 mix of vapour and liquid from the throttling device, and an operatively connectable mechanical subcooling system.

The present disclosure also provides a method for improving the energy efficiency ratio of a transcritical R-744 refrigeration system having at least one compressor for compressing R-744 vapors directed to a cooler operatively connected to a throttling device, for reducing the pressure and temperature of the R-744 vapors to a level required for the normal operation of the R-744 refrigeration system, through a first heat exchanger, the first heat exchanger being operatively connected to the at least one compressor to provide the R-744 vapors to the at least one first compressor and to receive compressed R-744 vapors from the at least one first compressor, a by-pass valve for maintaining a required flow of R-744 vapors through the first heat exchanger, and a receiver for receiving a R-744 mix of vapour and liquid from the throttling device, the method comprising mechanically subcooling of the R-744 vapors leaving the cooler by an operatively connectable mechanical subcooling system.

All of the foregoing and still further objects and advantages of the invention will become apparent from a study of the following specification, taken in connection with the accompanying drawings wherein like characters of reference designate corresponding parts throughout the several views.

BRIEF DESCRIPTION OF THE FIGURES

Embodiments of the disclosure will be described by way of examples only with reference to the accompanying drawing, in which.

DETAILED DESCRIPTION OF PREFERRED EMBODIMENTS

R-744 Transcritical Refrigeration System

Figure 1:
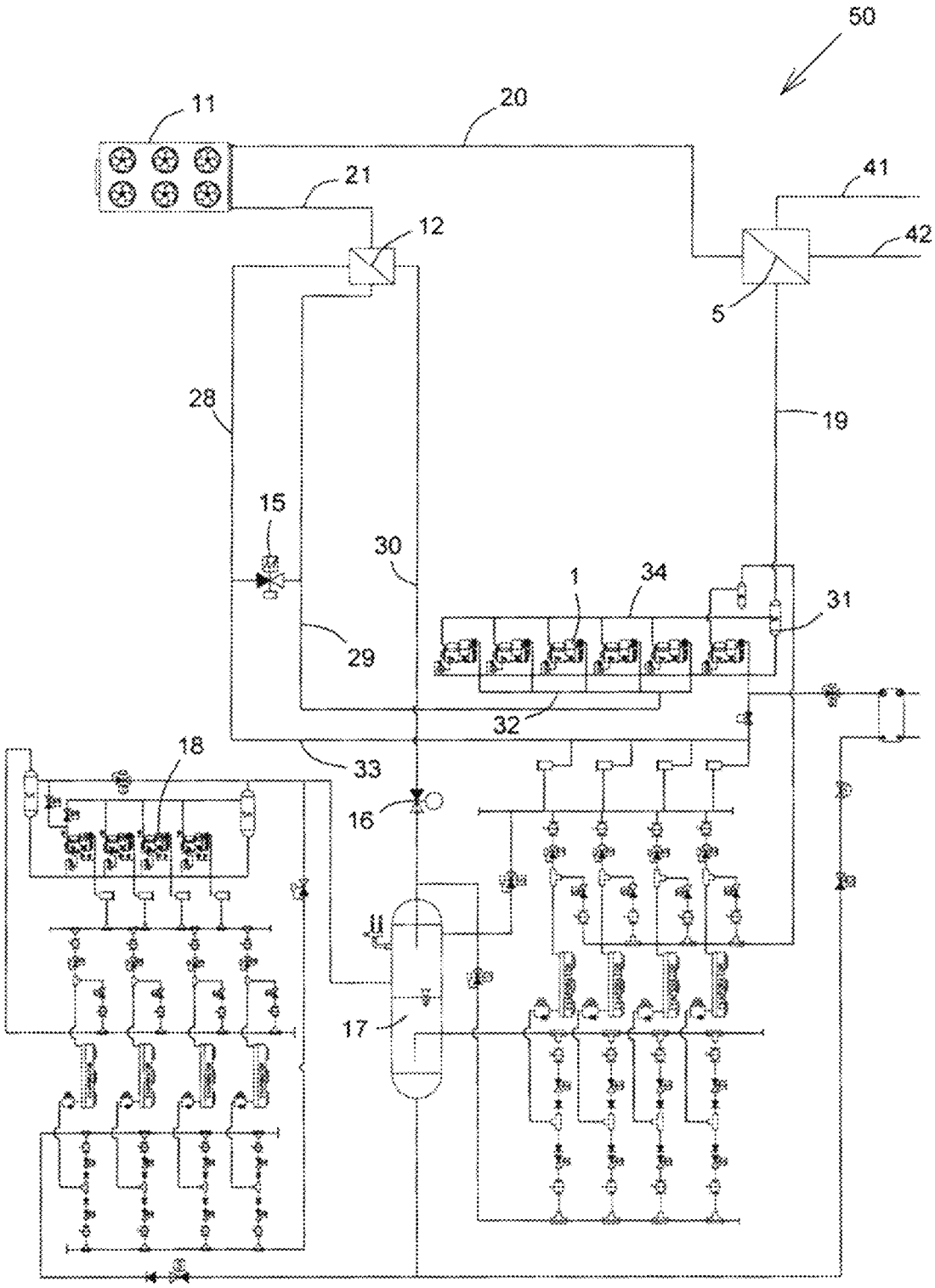
FIG.1 (PRIOR ART)
FIG. 1 is a schematic diagram of a typical transcritical R-744 refrigeration system.

Referring to FIG. 1, there is shown a typical R-744 transcritical refrigeration system 50. R-744 vapors are compressed by compressors 1 and directed through conduit 34, oil separator 31, conduit 19, heat exchanger 5 and conduit 20 to cooler 11, for example a gas cooler. The heat from the compressed R-744 vapors from compressors 1 is transferred in heat exchanger 5 to, for example, a glycol circulation system through conduits 41 and 42, to be used during the warm periods of the year for dehumidification purposes. From the cooler 11 the cooled transcritical R-744 vapors are directed through conduit 21, heat exchanger 12 and fed through conduit 30 to throttling device 16 where its pressure and temperature are reduced to a level required for the normal operation of the refrigeration system 50 both at low and medium temperatures and then is fed to receiver 17, which is operatively connected to defrost compressors 18. R-744 vapors from heat exchanger 12 are directed through conduit 29 and conduit 32 to the suction of compressors 1, which are connected through conduit 33 and conduit 28 to heat exchanger 12 where a heat transfer between R-744 vapors from the cooler 11 and the R-744 vapors from the suction of the compressors 1 takes place in order to insure stable suction temperature at a desired level. The by-pass valve 15 maintains the required flow of suction vapors through heat exchanger 12 in order to insure the required temperature of the suction vapors.

Figure 2:
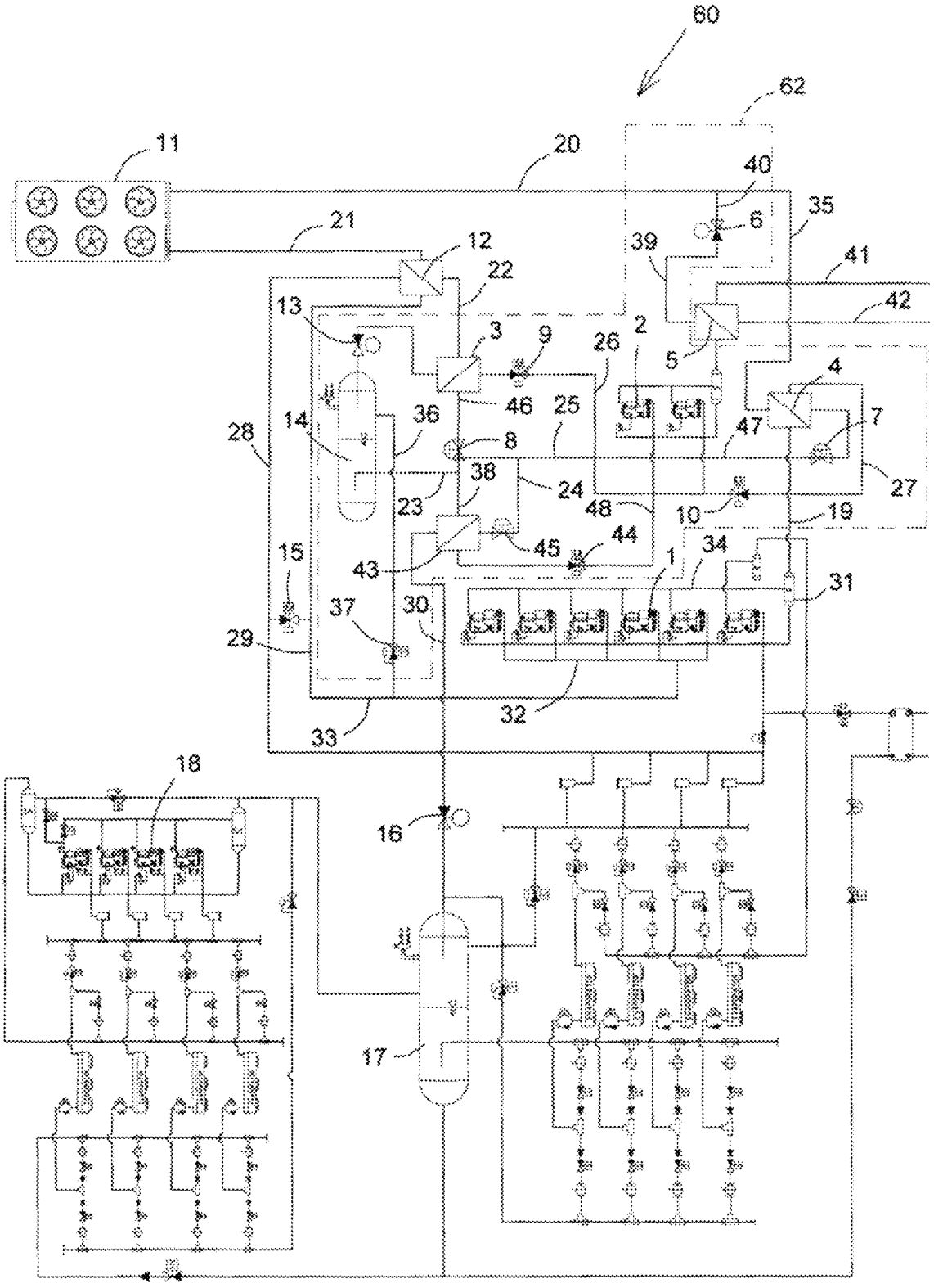
FIG.2 ( PRIOR ART)
FIG. 2 is a schematic diagram of the transcritical R-744 refrigeration system of FIG. 1 with mechanical subcooling system incorporated into the main refrigeration system.

R-744 Transcritical Refrigeration System with Mechanical Subcooling where the Subcooling Unit is an Integral Part of the Main Refrigeration System (FIG.2).

Referring now to FIG. 2, there is shown a transcritical R-744 refrigeration system with mechanical subcooling 60 which is basically the transcritical R-744 refrigeration system 50 of FIG. 1 to which mechanical subcooling 62 is added as an integral part of the system 50. The R-744 vapors compressed by compressors 1 are directed through conduit 34, oil separator 31, conduit 19, heat exchanger 4, conduit 35 and conduit 20 to cooler 11. From the cooler 11 the cooled transcritical R-744 vapors are directed through conduit 21, heat exchanger 12, conduit 22, heat exchanger 3 and throttling device 13 to receiver 14 where a separation of R-744 vapors and liquid occurs. The R-744 vapors from receiver 14 are fed through conduit 36 and pressure regulating valve (flash gas by-pass valve) 37 to conduit 33 and to conduit 32, and to the suction of compressors 1. The suction of compressors 1 is connected through conduit 33 and conduit 28 to heat exchanger 12 where a heat transfer between R-744 vapors from the cooler 11 and the R-744 vapors from the suction of the compressors 1 take place in order to insure stable suction temperature at a desired level. The by-pass valve 15 maintains the required flow of suction R-744 vapors through heat exchanger 12 in order to insure the required temperature of the suction vapors.

The compressors 2 are used for mechanical subcooling of the R-744 refrigerant leaving the cooler 11 through heat exchanger 3 or for heat reclaim through heat exchanger 4. Additional subcooling is provided for R-744 refrigerant leaving the receiver 14 by means of heat exchanger 43. The suction ports of compressors 2 are connected through motorized valves 9 and 44, and through conduits 26 and 48 to heat exchangers 3 and 43 or through motorized valve 10 and conduit 27 to heat exchanger 4.

When subcooling is required, valves 9 and 44 are open, and valve 10 is closed. Liquid R-744 is fed through conduits 23, 46 and 24 to expansion valves 8 and 45. The evaporation of the liquid R-744 in heat exchangers 3 and 43 absorbs heat from the R-744 refrigerant flowing through the other side of heat exchangers 3 and 43 (vapors in heat exchanger 3 and liquid in heat exchanger 43), thus reducing its temperature. The liquid R-744 is then fed through conduit 30 to throttling device 16 where its pressure and temperature are reduced to a level required for normal operation of the transcritical R-744 system 60 both at low and medium temperatures, and then is fed to receiver 17, which is operatively connected to the defrost compressors 18.

The evaporated R-744 refrigerant from heat exchangers 3 and 43 is fed through conduits 26 and 48, and through motorized valves 9 and 44 to the suction ports of compressors 2. The compressed R-744 vapors from compressors 2 are fed through heat exchanger 5 and conduit 39 to pressure regulating valve 6. From the pressure regulating valve 6 the R-744 vapors are fed through conduits 40 and 20 to cooler 11. The heat from the compressed R-744 vapors from compressors 2 is transferred in heat exchanger 5 to, for example, a glycol circulation system through conduits 41 and 42, and is used during the warm periods of the year for dehumidification purposes or water heating.

During colder periods of the year, where subcooling is not required, valves 8, 9, 44 and 45 are closed. Valves 7 and 10 are opened. Liquid R-744 is fed through conduits 23 and 47 to the expansion valve 7 and then to heat exchanger 4 where it evaporates and absorbs heat from the compressed R-744 vapors from compressors 1, which are fed through conduit 34, oil separator 31 and conduit 19 to heat exchanger 4.

The heat is then, by means of compressors 2, transferred in heat exchanger 5 to, for example, a glycol circulation system through conduits 41 and 42, and is used for comfort heating of the premises.

Figure 3:
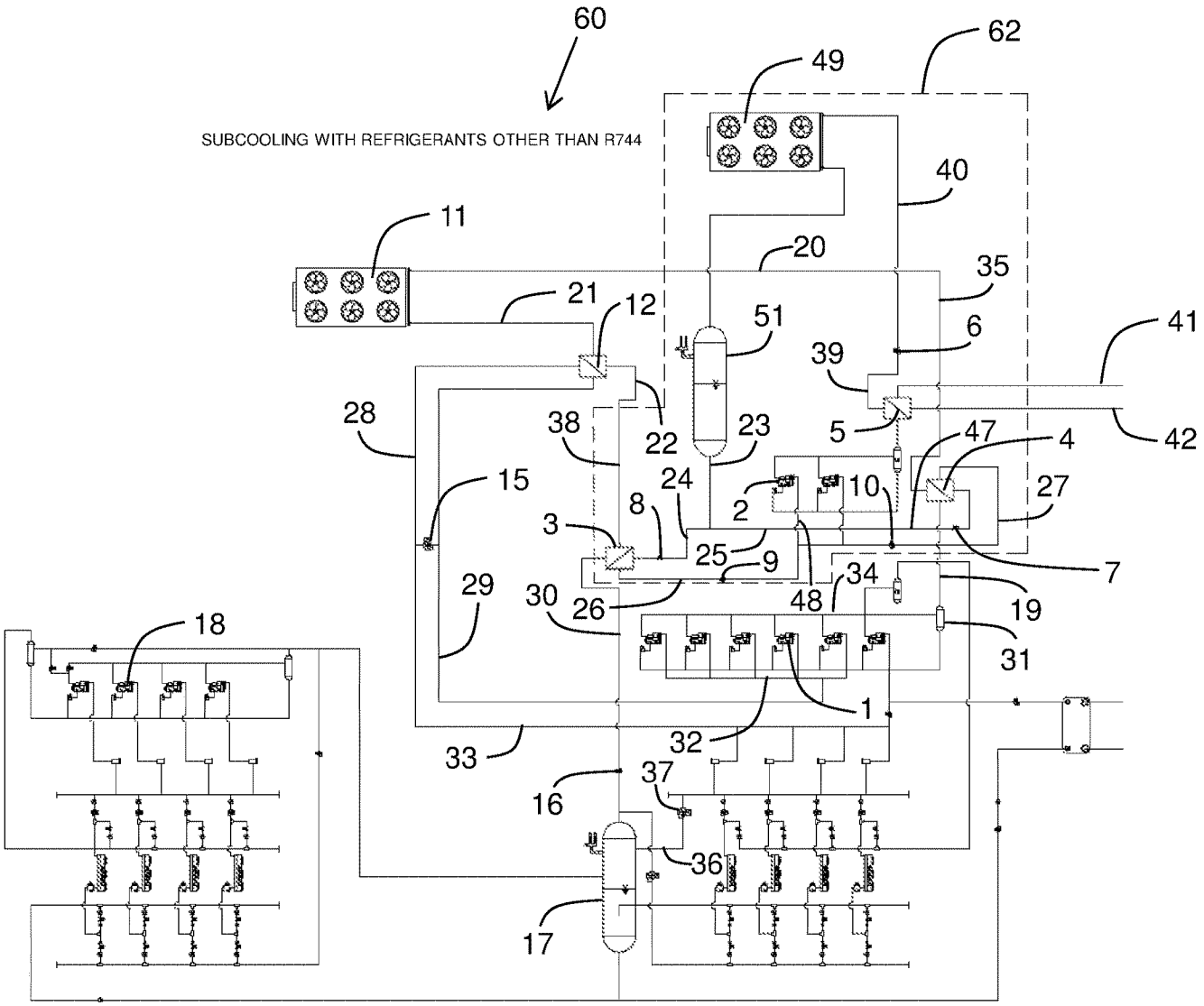
FIG. 3 is a schematic diagram of the transcritical R-744 refrigeration system of FIG. 1 with separate mechanical subcooling system using other than R-744 refrigerants.

R-744 Transcritical Refrigeration System with Mechanical Subcooling where the Subcooling Unit is not an Integral Part of the Main Refrigeration System and uses other than R 744 Refrigerants (FIG.3).

Referring now to FIG. 3, there is shown a transcritical R-744 refrigeration system with mechanical subcooling where the subcooling unit is not an integral part of the main refrigeration system and uses refrigerants other than R-744 , in accordance with an illustrative embodiment of the present disclosure. In such an embodiment, the mechanical subcooling system 62 is operatively connectable and subsequently removable from an existing R-744 refrigeration system, and thus is not required to be designed and built in conjunction with an R-744 refrigeration system. The R-744 vapors compressed by compressors 1 are directed through conduit 34, oil separator 31, conduit 19, heat exchanger 4, conduit 35 and conduit 20 to cooler 11. From the cooler 11 the cooled transcritical R-744 vapors are directed through conduit 21, heat exchanger 12, conduits 22 and 38, heat exchanger 3, conduit 30 and throttling device 16 to receiver 17 where a separation of R-744 vapors and liquid occurs. The R-744 vapors from receiver 17 are fed through conduit 36 and pressure regulating valve (flash gas by-pass valve) 37 to conduit 33 and conduit 28 to heat exchanger 12 where a heat transfer between R-744 vapors from the cooler 11 and the R-744 vapors from the suction of the compressors 1 take place in order to insure stable suction temperature at a desired level. The by-pass valve 15 maintains the required flow of suction R-744 vapors through heat exchanger 12 in order to insure the required temperature of the suction vapors.

The compressors 2 are used for mechanical subcooling of the R-744 refrigerant leaving the cooler 11 through heat exchanger 3 or for heat reclaim through heat exchanger 4. The suction ports of compressors 2 are connected through motorized valve 9, and through conduit 26 to heat exchanger 3 or through motorized valve 10 and conduit 27 to heat exchanger 4.

When subcooling is required, valves 9 is open, and valve 10 is closed. Liquid refrigerant is fed through conduits 23 and 24 to expansion valve 8. The evaporation of the liquid refrigerant in heat exchanger 3 absorbs heat from the R-744 refrigerant flowing through the other side of heat exchangers 3 thus reducing its temperature. Expansion valve 8 is operatively connected between receiver 51 and heat exchanger 3. Expansion valve 7 is operatively connected between receiver 51 and heat exchanger 4. The R-744 is then fed through conduit 30 to throttling device 16 where its pressure and temperature are reduced to a level required for normal operation of the transcritical R-744 system 60 both at low and medium temperatures, and then is fed to receiver 17.

The evaporated refrigerant from heat exchanger 3 is fed through conduits 26, through motorized valve 9 and through conduit 48 to the suction ports of compressors 2. The compressed refrigerant vapors from compressors 2 are fed through heat exchanger 5 and conduit 39 to pressure regulating valve 6. From the pressure regulating valve 6 the refrigerant vapors are fed through conduits 40 to condenser 49. The heat from the compressed refrigerant vapors from compressors 2 is transferred in heat exchanger 5 to, for example, a glycol circulation system through conduits 41 and 42, and is used during the warm periods of the year for dehumidification purposes or water heating.

During colder periods of the year, where subcooling is not required, valve 8 is closed. Valves 7 and 10 are opened. Liquid refrigerant is fed through conduits 23, 25 and 47 to the expansion valve 7 and then to heat exchanger 4 where it evaporates and absorbs heat from the compressed R-744 vapors from compressors 1, which are fed through conduit 34, oil separator 31 and conduit 19 to heat exchanger 4.

The heat is then, by means of compressors 2, transferred in heat exchanger 5 to, for example, a glycol circulation system through conduits 41 and 42, and is used for comfort heating of the premises.

When the glycol circulation system is not used, the heat exchanger 5 is eliminated and the hot compressed vapors from compressors 2 are fed to a set of heat reclaim coils ensuring direct heat transfer from the refrigerant vapors to the surrounding air.

Figure 4:
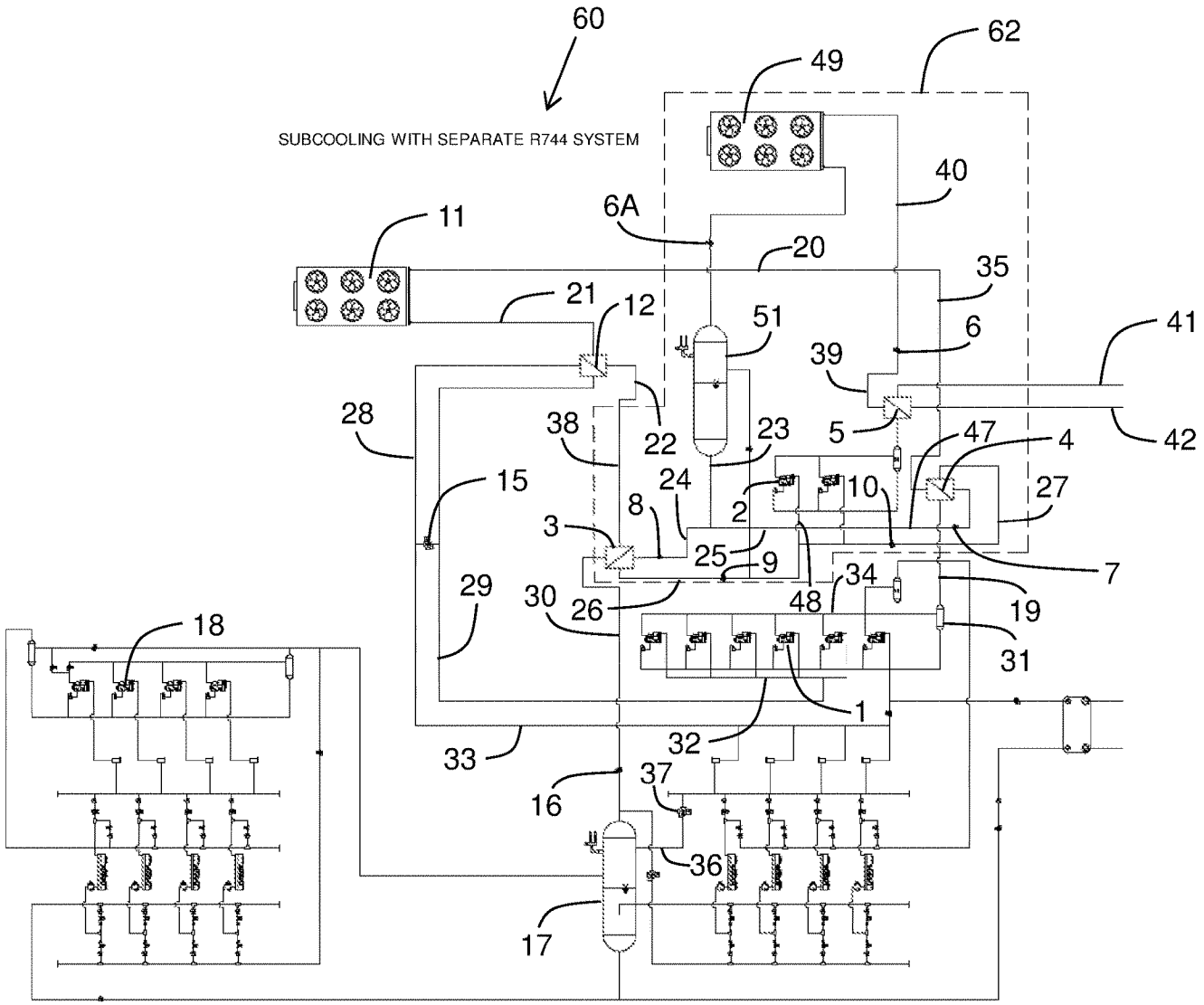
FIG. 4 is a schematic diagram of the transcritical R-744 refrigeration system of FIG. 1 with separate mechanical subcooling system using R-744 refrigerant.

R-744 Transcritical Refrigeration System with Mechanical Subcooling where the Subcooling Unit is not an Integral Part of the Main Refrigeration System and uses R 744 as Refrigerant (FIG.4).

The transcritical R744 system shown on FIG.4 operates exactly as the system shown in FIG.3 with the following differences:

The subcooling system uses R744 as its refrigerant

The heat exchanger 49 here is a gas cooler and not a condenser

There is additional throttling device 6A which is necessary to insure the operation of the subcooling system as a transcritical R744 system Energy Efficiency By using mechanical subcooling as disclosed above with a transcritical R-744 refrigeration system 60, the EER may go up to, for example, about 9.27 compared to the EER of a typical transcritical R-744 refrigeration system 50, which is about 6.09. The compressors 2 used for the mechanical subcooling have an energy efficiency ratio of about 14.00 due to their favorable operating conditions.

It is clear that the mechanical subcooling of R-744 transcritical refrigeration systems eliminates their major disadvantage of having low energy efficiency.

During the cold periods of the year, a transcritical R-744 refrigeration system with mechanical subcooling 60 can operate as a subcritical R-744 refrigeration system 50 and its energy efficiency then becomes similar to the energy efficiency of a Freon refrigeration system when the ambient air temperature is lower than about 12° C. (53.6° F.). No mechanical subcooling should be required during these periods. What is important, however, is that there is a need for heat recuperation for comfortable heating of the premises. The R-744 will provide heat but at a low temperature level of around 70° F., which is not appropriate for space heating.

During these periods the compressors 2 used for subcooling operate as a heat pump extracting heat from the refrigeration compressors 1 and elevate this heat to usable temperatures for space heating.

The scope of the claims should not be limited by the preferred embodiments set forth in the examples, but should be given the broadest interpretation consistent with the description as a whole.

The invention claimed is:

1. A transcritical R-744 refrigeration system having at least one first compressor (1) for compressing R-744 vapors directed to a cooler (11) operatively connected to a throttling device (16), for reducing the pressure and temperature of the R-744 vapors to a level required for the normal operation of the R-744 refrigeration system, through a first heat exchanger (12), the first heat exchanger (12) being operatively connected to the at least one first compressor (1) to provide the R-744 vapors to the at least one first compressor (1) and to receive compressed R-744 vapors from the at least one first compressor (1), a by-pass valve (15) for maintaining a required flow of R-744 vapors through the first heat exchanger (12), a first receiver (17) for receiving a R-744 mix of vapour and liquid from the throttling device (16), and the transcritical R-744 refrigeration system comprising and being operatively connectable to a mechanical subcooling system (62) comprising:

a second heat exchanger (4) operatively connected between the at least one first compressor (1) and the cooler (11);

a third heat exchanger (3) operatively connected between the first heat exchanger (12) and the first receiver (17) for subcooling the R-744 exiting the cooler (11);

a first pressure regulating valve or flash gas by-pass valve (37) for feeding R-744 vapors from the first receiver (17) to the at least one first compressor (1); and at least one second compressor (2) for mechanically subcooling of R-744 vapors leaving the cooler (11) through the third heat exchanger (3) or for heat reclaim through the second heat exchanger (4).

2. The transcritical R-744 refrigeration system of claim 1, further comprising a second pressure regulating valve (6) operatively connected between the at least one second compressor (2) and a condenser (49).

3. The transcritical R-744 refrigeration system of claim 1, further including a fourth heat exchanger (5) operatively connected between the at least one second compressor (2) and a condenser (49) for transferring heat to a circulation system to be used during warm periods for dehumidification purposes.

4. The transcritical R-744 refrigeration system of claim 3, further comprising a second pressure regulating device (6) operatively connected between the fourth heat exchanger (5) and the condenser (49).

5. The transcritical R-744 refrigeration system of claim 1, further comprising:

a first motorized valve (9) operatively connected between the third heat exchanger (3) and the at least one second compressor (2); and a second motorized valve (10) operatively connected between the second heat exchanger (4) and the at least one second compressor (2).

6. The transcritical R-744 refrigeration system of claim 5, wherein when subcooling is required, the first motorized valve (9) is open and the second motorized valve (10) is closed.

7. The transcritical R-744 refrigeration system of claim 5, further comprising:

a first expansion valve (8) operatively connected between a second receiver (51) and the third heat exchanger (3); and a second expansion valve (7) operatively connected between the second receiver (51) and the second heat exchanger (4).

8. The transcritical R-744 refrigeration system of claim 7, wherein when subcooling is not required, the first expansion valve (8) and the first motorized valve (9) are closed, and the second expansion valve (7) and the second motorized valve (10) are opened.

9. The transcritical R-744 refrigeration system of claim 8, further comprising a second throttling device (6A) operatively connected between the second receiver (51) and a gas cooler (49), wherein the subcooling system (62) uses R-744 as its refrigerant.

* * * * *